US010095253B2

(12) United States Patent
Whidden et al.

(10) Patent No.: US 10,095,253 B2
(45) Date of Patent: Oct. 9, 2018

(54) LADDER CIRCUITRY FOR MULTIPLE LOAD REGULATION

(71) Applicant: PeerNova, Inc., San Jose, CA (US)

(72) Inventors: Nick Whidden, San Jose, CA (US); Benjamin Scott Gorlick, Los Gatos, CA (US)

(73) Assignee: PEERNOVA, INC., San Jose, CA (US)

( * ) Notice: Subject to any disclaimer, the term of this patent is extended or adjusted under 35 U.S.C. 154(b) by 239 days.

(21) Appl. No.: 15/087,803

(22) Filed: Mar. 31, 2016

(65) Prior Publication Data

US 2016/0291621 A1 Oct. 6, 2016

Related U.S. Application Data

(60) Provisional application No. 62/140,832, filed on Mar. 31, 2015.

(51) Int. Cl.
*G05F 1/577* (2006.01)

(52) U.S. Cl.
CPC ..... *G05F 1/577* (2013.01)

(58) Field of Classification Search
CPC ..... G05F 1/577
See application file for complete search history.

(56) References Cited

U.S. PATENT DOCUMENTS 5,717,319 A * 2/1998 Jokinen ..... G05F 1/577 323/269
5,774,813 A * 6/1998 Jokinen ..... G05F 1/577 455/574
6,005,303 A * 12/1999 Hawkes ..... H02J 1/102 307/44
6,486,817 B1 * 11/2002 Okada ..... H03M 1/682 341/144
6,686,726 B1 * 2/2004 Boylan ..... G05F 1/56 323/266
7,015,847 B1 * 3/2006 McLachlan ..... H03M 1/1205 341/144
7,102,424 B2 * 9/2006 Vorenkamp ..... H03M 1/0602 327/104
2006/0043953 A1 * 3/2006 Xu ..... H02M 3/156 323/282
2008/0191920 A1 * 8/2008 Park ..... H03M 1/124 341/158
2008/0231115 A1 * 9/2008 Cho ..... H02J 1/08 307/41
2013/0307631 A1 * 11/2013 Lotfy ..... H03K 3/0315 331/34
2015/0137773 A1 * 5/2015 Miller ..... H02M 3/073 323/234
2015/0241890 A1 * 8/2015 Raychowdhury ..... G05F 1/56 713/300
2016/0202715 A1 * 7/2016 Petrov ..... G05F 1/56 323/280

OTHER PUBLICATIONS

Texas Instruments, "stacking the REF50xx for High voltage references," May 2013,pp. 1-9.*

* cited by examiner

*Primary Examiner* — Thienvu Tran
*Assistant Examiner* — Pinping Sun
(74) *Attorney, Agent, or Firm* — Fenwick & West LLP

(57) ABSTRACT

An electronic apparatus comprises several series-connected loads powered by a high voltage power source. To provide voltage regulation for each load, a ladder circuit is described. To automatically balance the voltage at output, one or more voltage-control-oscillators are included.

6 Claims, 14 Drawing Sheets

LADDER CIRCUITRY FOR MULTIPLE LOAD REGULATION

CROSS REFERENCE TO RELATED APPLICATION

This application claims the benefit of U.S. Provisional Application No. 62/140,832, filed Mar. 31, 2015, which is incorporated by reference herein in its entirety.

BACKGROUND OF THE INVENTION

Power consumption of digital integrated circuits is proportional to the square of applied voltage. The electronics industry has continually been driving power supply voltage levels ever lower as a means to reduce power consumption. At the same time, power density levels of integrated circuits have been increasing. As a result, the demand for low voltage/high current capacity power supplies has been ever growing.

Meanwhile, power distribution favors high voltage as a means to reduce copper losses and also the amount of copper required. As a result of the disconnection between power distribution and integrated circuit load requirements, a great burden is placed upon the power converter electronics to provide conversion of power from high voltage distribution grid down to the low voltage electronic load.

Traditional means of interfacing the low-voltage electronic loads to the distribution grid is through the use of one or several AC/DC and DC/DC power converters. IT equipment generally takes an AC input, rectifies the AC input to DC and provides voltage conversion to an intermediate bus voltage supply, between 12-56V for distribution within the IT equipment. One or more DC/DC converters step down the intermediate bus voltage to the low voltage supply required by the electronic loads.

SUMMARY OF THE INVENTION

The system and circuitry described herein utilizes a ladder of shunt circuitry to regulate output voltage provided to loads. The cost and efficiency of converting a unit of power from the grid to the load is generally a function of the conversion ratio ($V_{grid}/V_{load}$) and the number of converter stages. Thus, the cost of the power converters, and subsequently converter losses, may be reduced by providing a means of (a) eliminating power converter stages and/or (b) increasing the power converter output voltage requirements. Advantages of the technology described herein include reducing a burden on power converter circuits, regulating output voltage with smaller power consumption, and allowing realization of potential cost and efficiency savings.

In one embodiment, disclosed herein is a voltage regulator circuit for regulating output voltages across a plurality of loads at a plurality of output nodes. The output nodes include at least a first node, a second node, and a third node. A first load is coupled between a first output voltage at the first node and a second output voltage at the second node. A second load is coupled between the second output voltage at the second node and the third node. The voltage regulator circuit includes a first stage and a second stage coupled in series. The first stage includes a pass element coupled between the first node and the second node and in parallel to the first load. The pass element passes a current from the first node to the second node.

The second stage includes an error amplifier coupled to a reference voltage at a first input terminal and the second output voltage at a second input terminal. The error amplifier is configured to generate a control signal at an output terminal based on a comparison between the second output voltage and the reference voltage. The control signal is at a first polarity responsive to the second output voltage being greater than the reference voltage and at a second polarity responsive to the second output voltage being less than the reference voltage. The second stage also includes an adjustable element configured to adjust the current from the first node to the second node responsive to the control signal. The adjustable element increases the current responsive to the control signal at the first polarity and decreases the current responsive to the control signal at the second polarity to regulate the second output voltage at the second node.

In another embodiment, disclosed herein is a voltage regulator circuit for regulating output voltages across a plurality of loads at a plurality of output nodes. The output nodes include at least a first node, a second node, and a third node. A first load is coupled between a first output voltage at the first node and a second output voltage at the second node. A second load is coupled between the second output voltage at the second node and the third node. The voltage regulator circuit includes a first stage and a second stage coupled in series. The first stage includes a first voltage controlled oscillator coupled to a first reference voltage. The first voltage controlled oscillator is configured to output a first clock signal to the first load.

The second stage includes an error amplifier coupled to a second reference voltage at a first input terminal and the second output voltage at a second input terminal. The error amplifier is configured to generate a control signal at an output terminal based on a comparison between the second output voltage and the second reference voltage. The control signal is at a first polarity responsive to the second output voltage being greater than the reference voltage and at a second polarity responsive to the second output voltage being less than the reference voltage. The second stage also includes a second voltage controlled oscillator configured to adjust a second clock signal output to the second load. The second voltage controlled oscillator decreases a frequency of the second clock signal responsive to the control signal at the first polarity and increases the frequency of the second clock signal responsive to the control signal at the second polarity to regulate the second output voltage at the second node.

Additional aspects and advantages of the present disclosure will become readily apparent to those skilled in this art from the following detailed description, wherein only illustrative embodiments of the present disclosure are shown and described. As will be realized, the present disclosure is capable of other and different embodiments, and its several details are capable of modifications in various obvious respects, all without departing from the disclosure. Accordingly, the drawings and description are to be regarded as illustrative in nature, and not as restrictive.

BRIEF DESCRIPTION OF THE DRAWINGS

The novel features of the invention are set forth with particularity in the appended claims. A better understanding of the features and advantages of the present invention will be obtained by reference to the following detailed description that sets forth illustrative embodiments, in which the principles of the invention are utilized, and the accompanying drawings (also "FIG." and "FIGs." herein), of which:

DETAILED DESCRIPTION

While various embodiments of the invention have been shown and described herein, it will be obvious to those skilled in the art that such embodiments are provided by way of example only. Numerous variations, changes, and substitutions may occur to those skilled in the art without departing from the invention. It should be understood that various alternatives to the embodiments of the invention described herein may be employed. It shall be understood that different aspects of the invention can be appreciated individually, collectively, or in combination with each other.

In systems with a plurality of low-voltage loads of nominal current I and variance i, powering the loads from a high voltage source as a series-connected voltage ladder is possible. Such a topology may be used to reduce the cost of DC/DC converters or eliminate a converter stage entirely. In the case of digital integrated circuits, variance in the loading can exist between devices due to process, voltage and temperature differences. Further, integrated circuits may specify an operating voltage tolerance typically in the range of 3-5%. If left unregulated, an error may exist in the applied voltage to each device which can lead to (a) device malfunction and/or (b) damage to the device. Thus, a compensation mechanism is desirable to ensure stable and regulated voltage is provided to each load.

The topology described herein includes N loads of nominal current I and variance i stacked in a ladder circuit. A linear shunt regulator topology is extended to a ladder topology to compensate for loading mismatch, resulting in a regulated voltage at each stage in the ladder. The new topology is a stacked-shunt ladder regulator.

Stacked-Shunt Ladder Regulator

A stacked-shunt ladder regulator reduces a burden on power converter circuits, allowing realization of potential cost and efficiency savings. Furthermore, the regulator can be used in place of several DC/DC converters.

If unregulated, a ladder circuit of N loads, each with nominal load current I and variance i, may have a maximum voltage deviation of:

$$\frac{\Delta V}{V}[\%] = \frac{2(1-1/N)i/I}{1+(1-2/N)i/I} * 100\%$$

Figure 1:
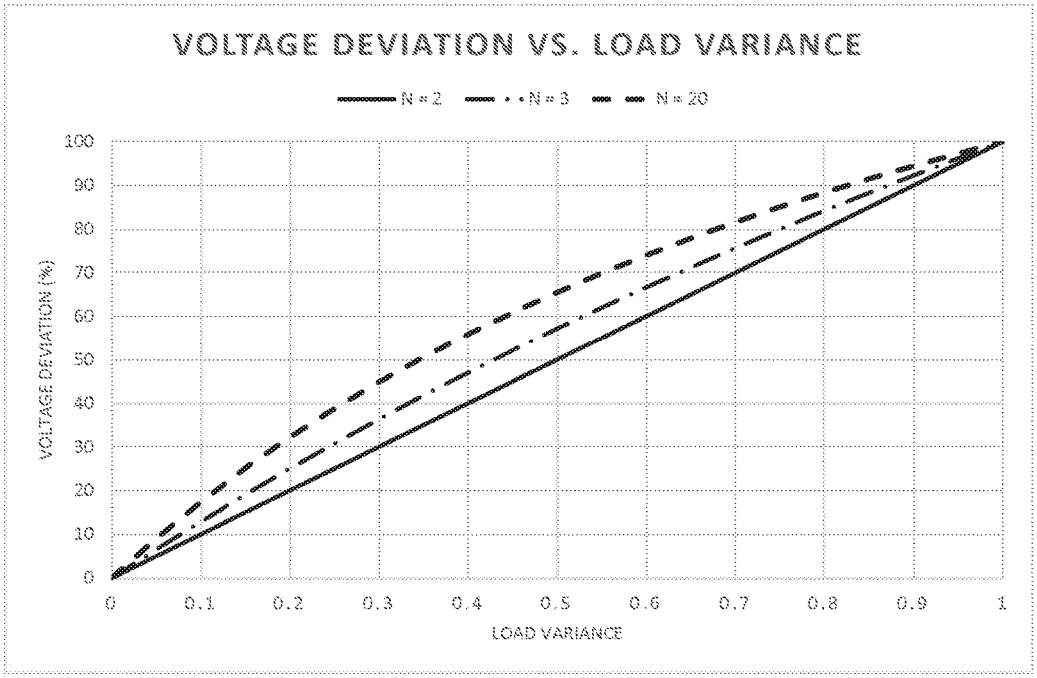
FIG. 1 depicts a plot of a maximum load voltage deviation versus a normalized load variation.
Figure 2:
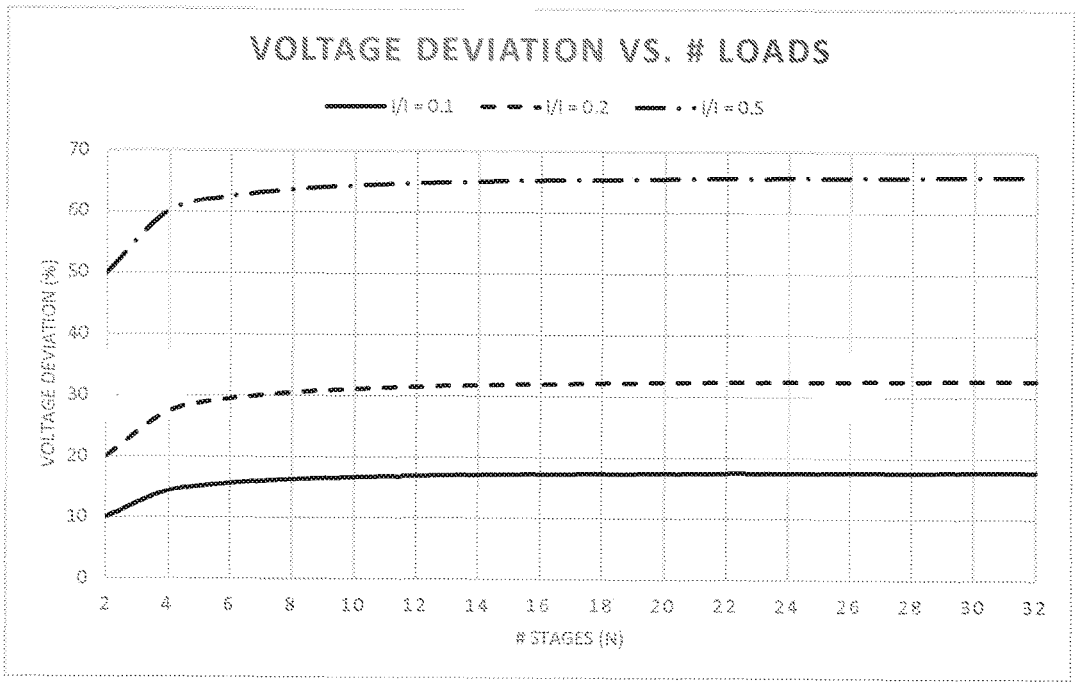
FIG. 2 depicts a plot of a maximum load voltage deviation versus a number of ladder stages.

FIG. 1 includes plots of maximum voltage deviation $$\frac{\Delta V}{V}$$

versus load variance i/I for afferent number of loads N. FIG. 1 includes a plot for each of the following number N of loads: 2, 3, and 20. As can be seen in FIG. 1, the higher the N, the more voltage deviation incurs. FIG. 2 plots the voltage deviation $$\frac{\Delta V}{V}$$

versus the number N of loads for different load variances i/I. It is apparent from FIG. 2 that when the load variance i/I increases, the voltage deviation $$\frac{\Delta V}{V}$$

becomes higher. In other words, the load variance may induce voltage variation, which may be an undesirable condition. Therefore, systems, apparatus, and methods described herein provide improved voltage regulation, which reduces voltage variation.

To remove this voltage deviation, a stacked-shunt ladder regulator circuit is used to compensate for the variance i which exists between loads. The stacked-shunt ladder regulator circuit can be understood by first considering a linear shunt regulator principle, then extending it to an N-stage ladder circuit.

Figure 3:
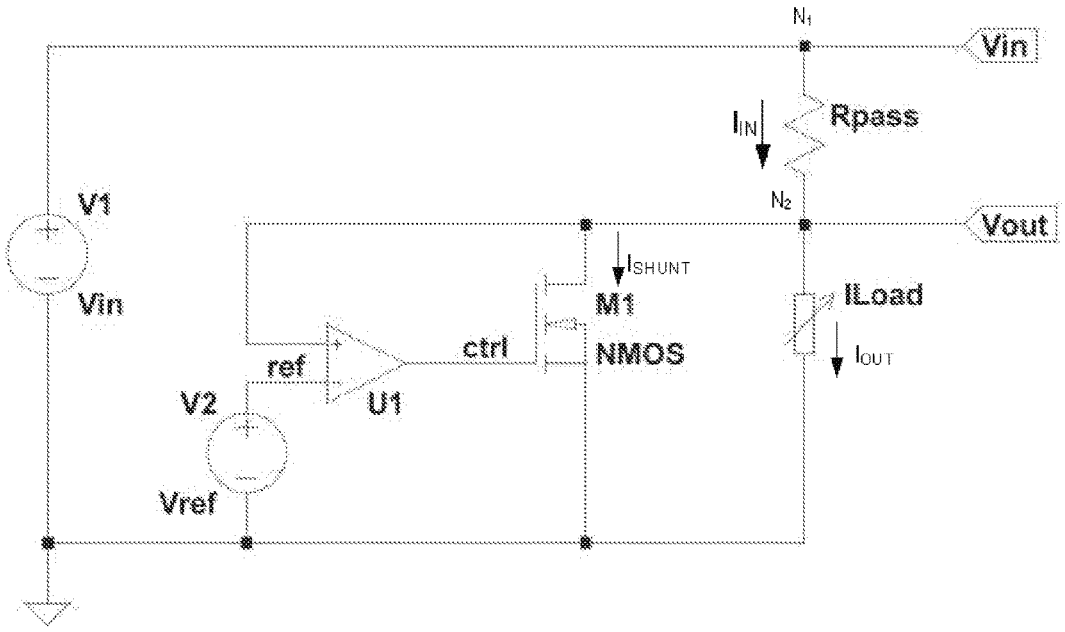
FIG. 3 depicts a circuit diagram of a linear shunt regulator.

A shunt regulator depicted in FIG. 3 ensures a constant current through a pass device $R_{pass}$. Referring to FIG. 3, the shunt regulator includes the pass device $R_{pass}$, an input voltage $V_{in}$ with voltage level $V_1$, a reference voltage $V_{ref}$ with voltage level $V_2$, an error amplifier $U_1$, an n-type metal-oxide-semiconductor (NMOS) $M_1$, a node $N_1$ and a node $N_2$. The input voltage $V_{in}$ is connected to node $N_1$. One end of the pass device $R_{pass}$ is connected to node $N_1$ and another end of the pass device $R_{pass}$ is connected to node $N_2$, which has an output voltage $V_{out}$. Hence, the pass device $R_{pass}$ is inserted between input voltage $V_{tin}$ and output voltage $V_{out}$. The reference voltage $V_{ref}$ is connected to a negative input terminal of the error amplifier $U_1$. An output of the amplifier $U_1$ is connected to the gate of the NMOS $M_1$. A positive input terminal of the amplifier $U_1$ and the drain of the NMOS $M_1$ and are connected to node $N_2$, which creates a feedback loop. The source of the NMOS $M_1$ is connected to ground. An output load $I_{load}$ is connected to node $N_2$ and ground (parallel to NMOS $M_1$) to receive the output voltage $V_{out}$ which is regulated. The regulated output voltage $V_{out}$ is equal to:

$$V_{out}=V_{in}-I_{in}R_{pass}$$

$$I_{in}=I_{out}+I_{shunt}$$

In some embodiments, as $I_{out}$ changes from light load to heavy load, $I_{shunt}$ reacts in an equal and opposite manner to keep $I_{in}$ constant, and as a result $V_{out}$ is regulated to a constant voltage. By sinking more or less current through the shunt, the dropout voltage $I_{in}R_{pass}$ may be adjusted as necessary to fix $V_{out}$ to the desired voltage. More specifically, to regulate the output voltage $V_{out}$, the error amplifier $U_1$ compares the output voltage $V_{out}$ at node $N_2$ to the reference voltage $V_{ref}$ and generates a control signal ctrl. If the output voltage $V_{out}$ at node $N_2$ is greater than the reference voltage $V_{ref}$, the control signal ctrl will have a positive polarity. The greater the magnitude of the control signal ctrl with the positive polarity, the more $I_{shunt}$ increases which causes $I_{in}$ to increase and the output voltage $V_{out}$ at node $N_2$ to decrease. However, if the output voltage $V_{out}$ is less than the reference voltage $V_{ref}$, the control signal ctrl will have a negative polarity. The greater the magnitude of the control signal ctrl with the negative polarity, the more $I_{shunt}$ decreases which causes $I_{in}$ to decrease and the output voltage $V_{out}$ at node $N_2$ to increase.

The efficiency of the shunt regulator is as follows:

$$\eta = \frac{V_{out}I_{out}}{V_{in}I_{in}} = \frac{V_{out}}{V_{in}}\left\{\frac{1}{1 + I_{shunt}/I_{out}}\right\}$$

Based on the above, the shunt regulator can hold the following properties/characteristics:

1. The pass device $R_{pass}$ may be sized for the heavy load condition to ensure load regulation:

$$R_{pass} \le \frac{V_{in} - V_{out}}{I_{out,max}}$$

$I_{out,max}$ is the maximum current of the output load $I_{load}$.

2. A constant-power topology may be utilized. As the load current $I_{out}$ reduces from maximum to minimum, the shunt elements (NMOS $M_1$ and error amplifier $U_1$) may increase current $I_{shunt}$ from minimum to maximum. As a result, efficiency greatly suffers at light load.
3. Maximum power dissipation in the shunt elements may be equal to the maximum output power.

A stacked-shunt ladder regulator extends the principle of the shunt regulator into a ladder circuit topology. The topology finds cost-effective use in systems with several low-voltage loads for tight voltage regulation, and which may not be referenced to the system ground. Loads with small variance in power dissipation may be ideal to minimize losses in the shunt elements.

Figure 4:
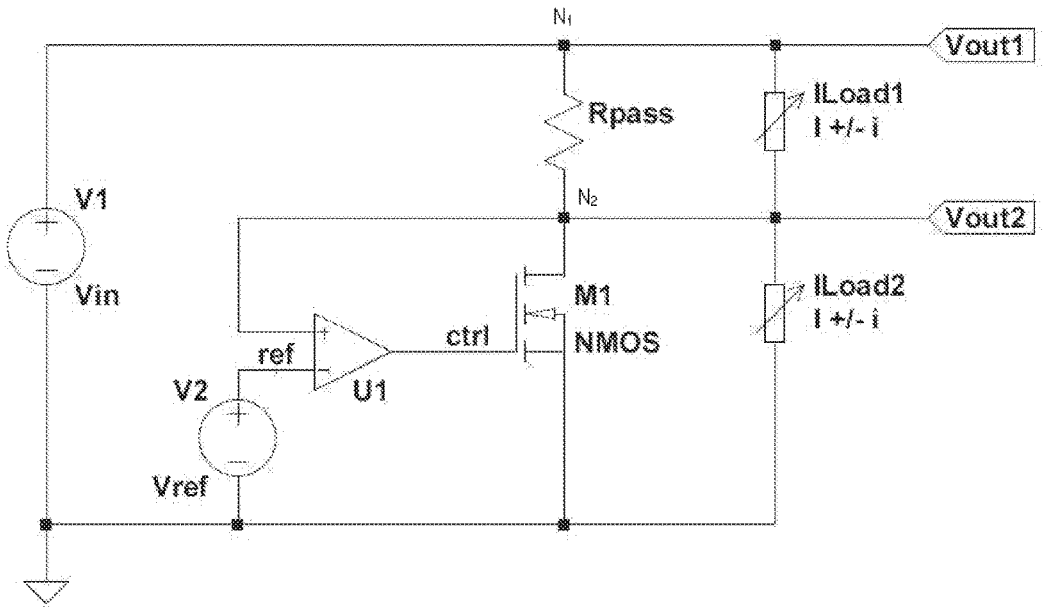
FIG. 4 depicts a circuit diagram of a 2-stage linear stacked-shunt ladder.

A stacked-shunt ladder regulator with two stages according to one embodiment is described in FIG. 4. The stacked-shunt ladder regulator includes the same circuitry as the shunt regulator of FIG. 3, except to create the two stage ladder, an additional load $I_{load1}$ is connected between node $N_1$ and node $N_2$. The load $I_{load1}$ is in parallel with the pass element $R_{pass}$. The first stage of the stacked-shunt ladder regulator (also referred to as the unregulated stage) includes the pass element $R_{pass}$ in parallel with the load $I_{load1}$, which receives output voltage $V_{out1}$ at node $N_1$. The second stage includes the error amplifier $U_1$ and the NMOS $M_1$ similar to the circuit of FIG. 3, which are connected in parallel with load $I_{load2}$ (referred to as $I_{load}$ in FIG. 3). The load $I_{load2}$ receives output voltage $V_{out2}$ at node $N_2$. The first stage and the second stage are connected in series. Further, the loads $I_{load1}$ and $I_{load2}$ are considered to consume nominal current I, with variance i.

Each load is regulated to equal voltage, thus $V_{in}=2V_{out}$, where $V_{out}$ is the voltage across each of the loads $I_{load1}$ and $I_{load2}$. In an N-stage ladder where there are N loads, $V_{in}=NV_{out}$. Now, the pass and shunt elements compensate for load variance i, instead of the min-to-max load variation as in the traditional shunt regulator topology.

The pass element $R_{pass}$ may be sized to accommodate for the maximum load spread between $I_{load1}$ and $I_{load2}$, in contrast with the traditional shunt regulator where the pass element $R_{pass}$ may be sized to source the maximum load current.

$$R_{pass} \le \frac{V_{in} - V_{out}}{I_{load2,max} - I_{load1,min}} \le \frac{2V_{out} - V_{out}}{I + i - (I - i)}$$

$$R_{pass} \le \frac{V_{out}}{2i}$$

The efficiency is:

$$\eta = \frac{P_{out}}{P_{out} + P_{loss}} = \frac{V_{out}(I_{load1} + I_{load2})}{V_{out}(I_{load1} + I_{load2} + I_{pass} + I_{shunt})}$$

$$\eta = \frac{I_{load1} + I_{load2}}{I_{load1} + I_{load2} + I_{pass} + I_{shunt}}$$

$P_{out}$ is the total output power, $P_{loss}$ is the power loss by the pass element $R_{pass}$ and the NMOS $M_1$, $I_{load1}$ is the current of the load $I_{load1}$, $I_{load2}$ is the current of the load $I_{load2}$, $I_{pass}$ is the current through the pass element $R_{pass}$, and $I_{shunt}$ is the current through NMOS $M_1$.

Maximum or increased efficiency occurs when $I_{load1}=I-i$ and $I_{load2}=I+i$. In this case, the shunt element is off while $R_{pass}$ conducts 2i:

$$\eta_{max} = \frac{I - i + I + i}{I - i + I + i + 2i + 0} = \frac{1}{1 + i/I}$$

The minimum or decreased efficiency occurs when $I_{load1}=I+i$ and $I_{load2}=I-i$. In this case, the shunt element conducts 4i while $R_{pass}$ conducts 2i:

$$\eta_{min} = \frac{I + i + I - i}{I + i + I - i + 2i + 4i} = \frac{2I}{2I + 6i}$$

$$\eta_{min} = \frac{1}{1 + 3i/I}$$

Figure 5:
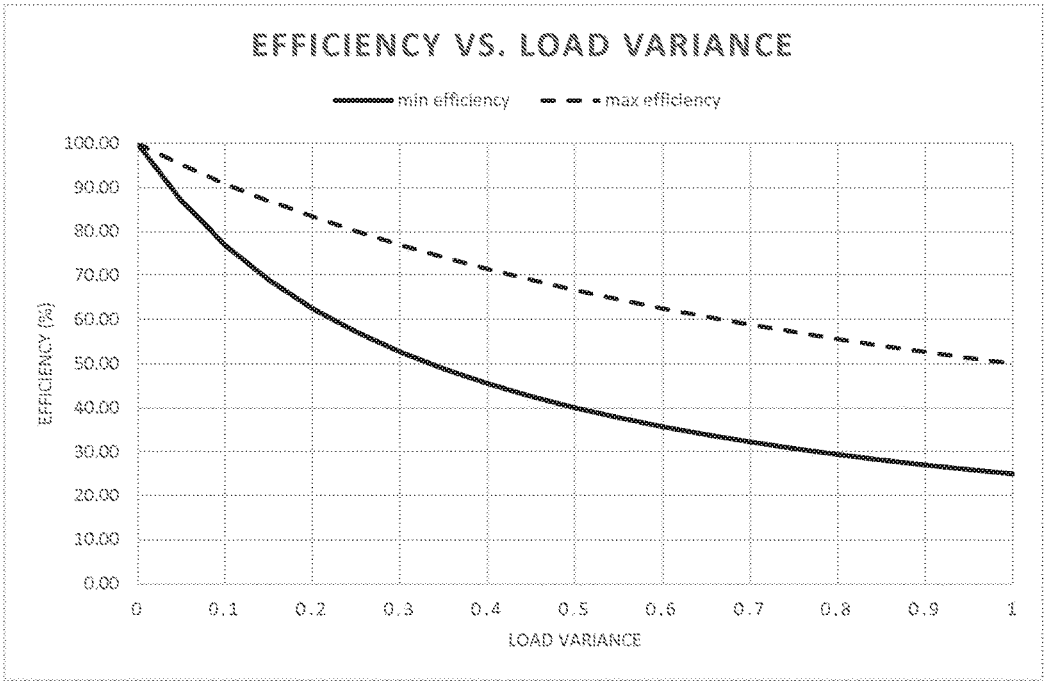
FIG. 5 depicts a plot of an efficiency versus a normalized load variation for a 2-stage linear stacked-shunt ladder.

Thus, the ladder topology's efficiency may be a factor of the normalized variance i/I between loads. In systems where the load variance, and spread between loads, can be managed effectively, power losses can be kept within acceptable levels. Efficiency versus normalized variance i/I is plotted in FIG. 5. Referring to FIG. 5, when a load variance is large, the efficiency may become lower. Thus, if the load variance can be regulated to become smaller, the circuit's efficiency can be increased.

Figure 6:
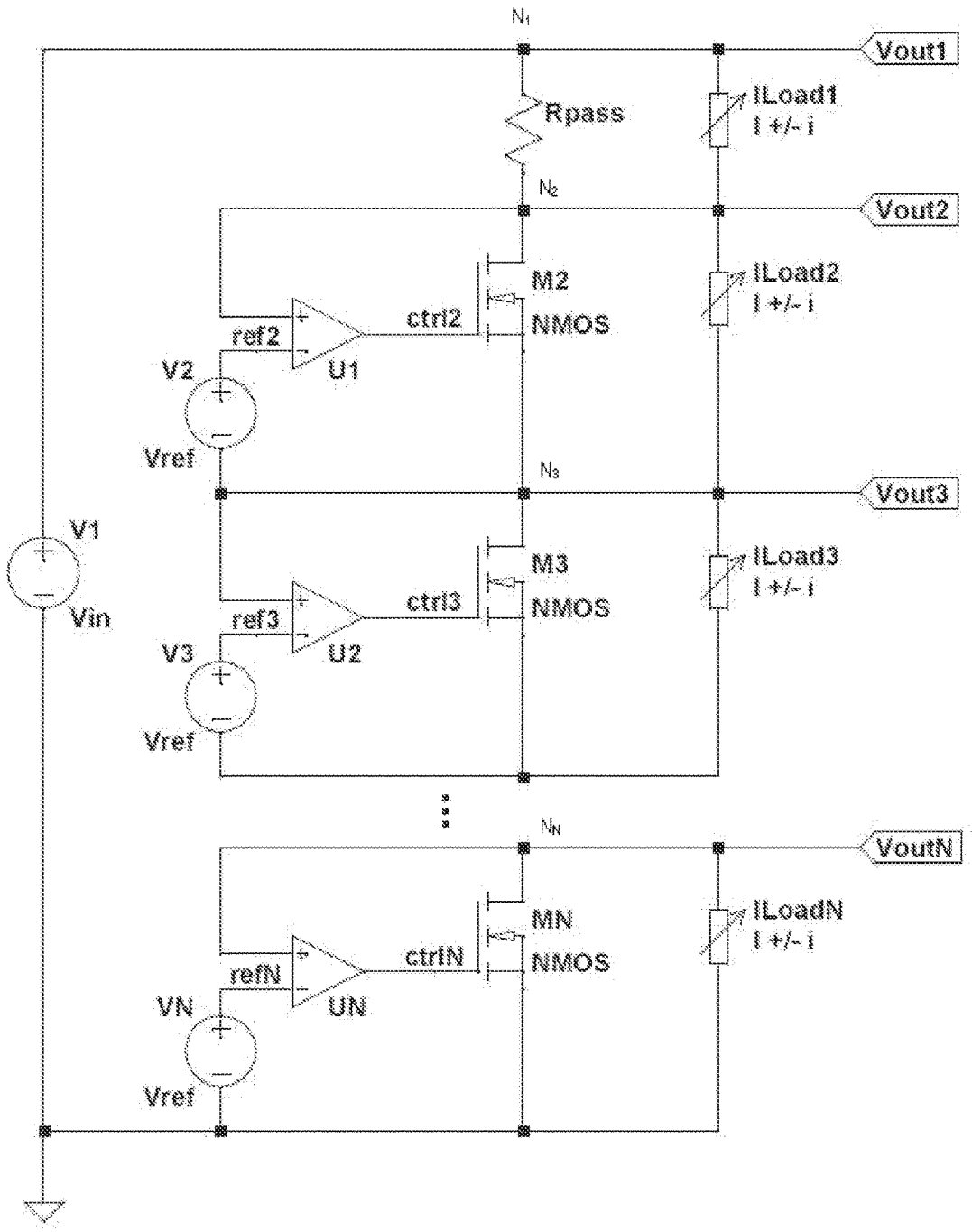
FIG. 6 depicts a circuit diagram of an N-stage stacked-shunt ladder.

Consecutive stages of loads and shunt elements may be added under a 2-stage ladder in series to form the N-stage ladder circuit according to another embodiment, shown in FIG. 6. The N-stage ladder circuit may occur as any multi-stage ladder circuit. Any number of stages may be provided. For example, two, three, four, five, six, or more stages may be arranged. N can be any whole number of 2 or greater. As in FIG. 4, the first load $I_{load1}$ is connected in parallel to a pass element $R_{pass}$, where the sizing of the pass element may remain the same. The remaining loads $I_{load2}, \ldots, I_{loadN}$ are coupled with shunt elements.

Non-limiting examples of a pass element include resistors, capacitors, inductors, and another electronic circuit. In some embodiments, a pair of stages may be inserted with another electronic element/circuit. In some cases, there may be a variation in the circuitry; for instance, the unregulated stage may be simply a pass device (e.g., resistor or diode) instead of a load in parallel with the pass element $R_{pass}$, similar to traditional shunt topology.

The input voltage, $V_{in}$, may be divided evenly among the loads in the ladder, that is, $V_{out}=V_{in}/N$ where $V_{out}$ is the supply voltage for each load. The choice of N for a given load generally depends on the available $V_{in}$, which is the intermediate bus voltage provided by the IT equipment's AC/DC power supply unit (PSU), typically 12V, 24V, 48V or 56V. For example, a 12V input and loads with nominal operating voltage of 0.8V may require a ladder of 15 stages to regulate the supply voltages to the nominal 0.8V.

Efficiency for the N-stage ladder is:

$$\eta = \frac{P_{out}}{P_{out} + P_{loss}} = \frac{V_{out} * \sum_{n=1}^{N} I_{load,n}}{V_{out} * \sum_{n=1}^{N} I_{load,n} + V_{out} I_{pass} + V_{out} * \sum_{n=1}^{N} I_{shunt,n}}$$

$$\eta = \frac{\sum_{n-=1}^{N} I_{load,n}}{\sum_{n=1}^{N} I_{load,i} + I_{pass} + \sum_{n=1}^{N} I_{shunt,n}}$$

Maximum or increased efficiency occurs when $I_{load1}=I-i$ and $I_{load,n}=I+i$. In this case, the shunts are off while $R_{pass}$ conducts 2i:

$$\eta_{max} = \frac{I - i + \sum_{n=1}^{N} (I + i)}{I - i + \sum_{n=1}^{N} (I + i) + 2i + 0} = \frac{NI + (N-2)i}{NI + Ni}$$

$$\eta_{max} = \frac{1 + (1 - 2/N)i/I}{1 + i/I}$$

Minimum or decreased efficiency occurs when $I_{load1}=I+i$ and $I_{load,n}=I-i$. In this case, the shunts conduct 4i while $R_{pass}$ conducts 2i:

$$\eta_{min} = \frac{P_{out}}{P_{in}} = \frac{V_{out}(I + i) + V_{out} \sum_{n=1}^{N} (I - i)}{NV_{out}(I + i + 2i)} = \frac{1 - i/I + (2/N)i/I}{1 + 3i/I}$$

$$\eta_{min} = \frac{1 - (1 - 2/N)i/I}{1 + 3i/I}$$

Figure 7:
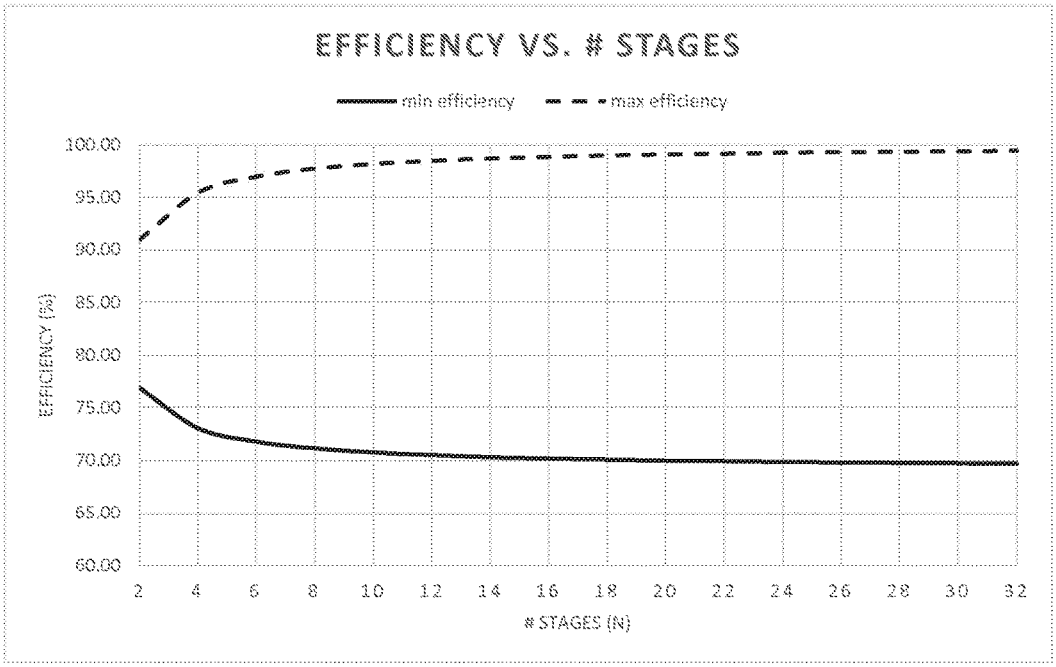
FIG. 7 depicts a plot of an efficiency versus a number of stages for an N-stage stacked-shunt ladder topology with a normalized load variation of 10%.

Efficiency versus number of stages, with normalized load variance of 10% is plotted in FIG. 7. As FIG. 7 depicts, an increase in the number of stages may lead to a higher maximum efficiency and a lower minimum efficiency.

Based on the above, the linear stacked-shunt ladder topology may hold one or more of the following properties/characteristics:

1. Efficiency is a function of number of stages and loading mismatch between stages, and efficiency approaches 100% as number of stages increases and loading mismatch reduces. The topology may be very attractive in systems which can dynamically control the loads to maximize efficiency.
2. Maximum power dissipation in the shunt elements may be equal to four times the load variance.
3. Similar to the traditional shunt regulator, the stacked-shunt ladder regulator described herein may behave like a constant power topology.

The stacked-shunt ladder regulator described herein comprises an adjustable shunt element. The adjustable shunt element comprises an NMOS. However, in other embodiments instead of an NMOS, other devices may be used to provide the same result, including but not limited to, p-type metal-oxide-semiconductor (PMOS) transistors and NPN/PNP-type bipolar junction transistors (BJTs). Some circuit modifications may accommodate specific shunt elements. For example, PMOS/PNP devices are naturally high-side shunts while NMOS/NPN devices are low-side shunts.

Figure 8:
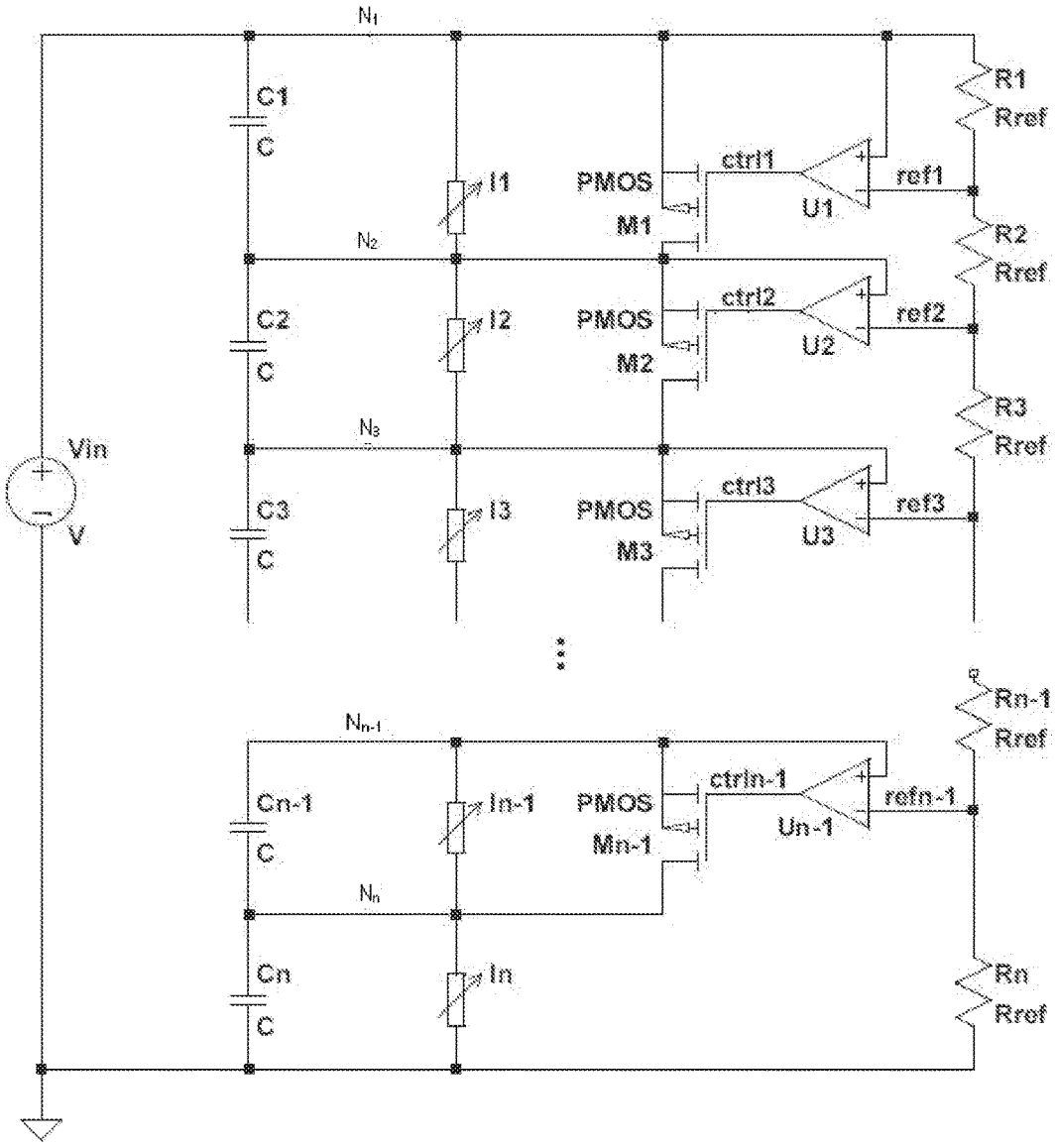
FIG. 8 depicts a circuit diagram of an N-stage stacked-shunt ladder with a p-type metal-oxide-semiconductor (PMOS) shunt.

To utilize PMOS/PNP shunts, the unregulated stage becomes ground-referenced as shown according to still another embodiment in FIG. 8. FIG. 8 illustrates n stages of a stacked-shunt ladder regulator 800 according to still another embodiment. The first stage includes a capacitor $C_1$, a PMOS $M_1$, an error amplifier $U_1$, a pass device $R_1$, node $N_1$, and node $N_2$. An input voltage $V_{in}$ is connected to node $N_1$. A first end of the capacitor $C_1$ is connected to node $N_1$ and a second end of the capacitor $C_1$ is connected to a node $N_2$. The source of the PMOS $M_1$ is connected to the node $N_1$ and the drain is connected to node $N_2$. The gate of the PMOS $M_1$ is connected to the output of the error amplifier $U_1$. A positive input terminal of the error amplifier $U_1$ is connected to node $N_1$. A first end of the pass device $R_1$ is connected to node $N_1$ and a second end of the pass device $R_1$ is connected to a negative input terminal of the error amplifier $U_1$. A first end of a pass device $R_2$ from the second stage is also connected to the negative input terminal of the error amplifier $U_1$. A load $I_1$ is connected between node $N_1$ and node $N_2$.

The second stage includes a capacitor $C_2$, a PMOS $M_2$, an error amplifier $U_2$, the pass device $R_2$, the node $N_2$ and a node $N_3$. A first end of the capacitor $C_2$ is connected to node $N_2$ and a second end of the capacitor $C_1$ is connected to node $N_3$. The source of the PMOS $M_2$ is connected to node $N_2$ and the drain is connected to node $N_3$. The gate of the PMOS $M_2$ is connected to the output of the error amplifier $U_2$. A positive input terminal of the error amplifier $U_2$ is connected to node $N_2$ and a second end of the pass device $R_2$ is connected to a negative input terminal of the error amplifier $U_2$. A first end of a pass device $R_3$ from the third stage is also connected to the negative input terminal of the error amplifier $U_2$. A load $I_2$ is connected between node $N_2$ and node $N_3$.

Each of the subsequent stages includes the same components and is connected to the preceding stage as described for the second stage, except for the $n^{th}$ stage, which is that last stage that is unregulated. As described above the unregulated stage is ground-referenced. The last stage includes capacitor $C_n$, pass device $R_n$, and node N. A first end of the capacitor $C_n$ is connected to node $N_n$ and a second end of the capacitor $C_n$ is connected to ground. A first end of the pass device $R_n$ is connected to a negative input terminal of an error amplifier $U_{n-1}$ from the preceding stage and a second end of the pass device $R_n$ is connected to ground. A load $I_n$ is connected between node $N_n$ and ground.

According to the various embodiments herein, properties and/or characteristics of loads suitable for the ladder topology include, but not limited to, (a) low current transient characteristics (relatively constant current or controlled current device); (b) a start-up mechanism to control the ramp rate of current from idle load to full load; and (c) once at full load, remain at full load until power is removed from the system. The system as a whole may consist of several similar loads described above with properties (a)-(c). In one embodiment, each load is an application-specific integrated circuit (ASIC) designed to perform Bitcoin mining operations, such as computing cryptographic hashes at a high rate.

AC Small Signal Analysis

Figure 9:
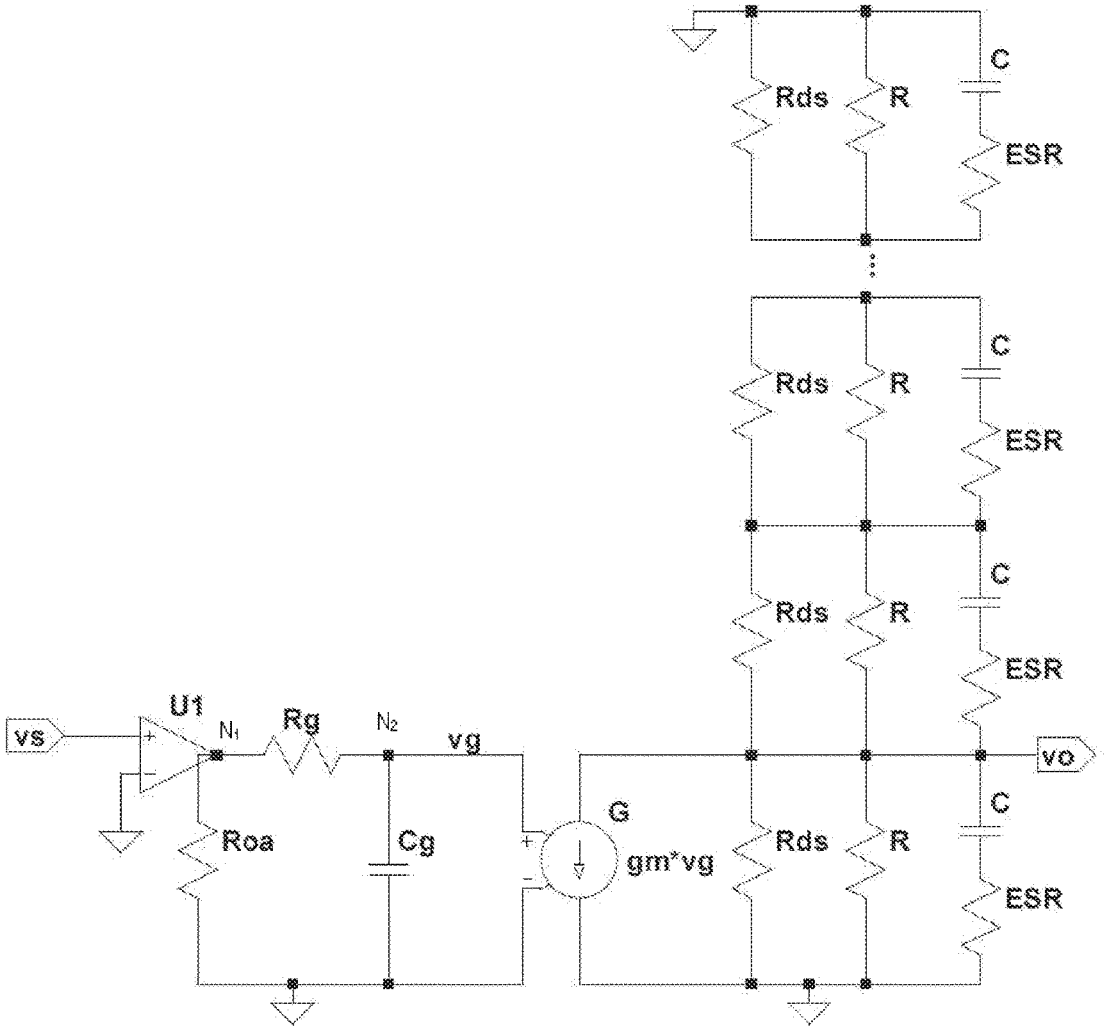
FIG. 9 depicts a circuit diagram of a small signal circuit model for a stacked-shunt ladder topology.

A small signal model of the circuit can be obtained by considering only one feedback loop and its loading effects. An example small signal model is shown in FIG. 9. The small signal model includes a current source G connected in parallel to multiple load impedances $R(V_{out}/I_{out})$ and multiple shunt MOSFET drain-source impedances $R_{DS}$. Multiple bulk output capacitances C and their corresponding parasitic resistance ESR are also connected in parallel to the current source G. The current source G is connected to a circuit that includes an opamp $U_1$ with a positive input terminal connected to a voltage source $V_s$ and a negative input connected to ground. An output of the opamp $U_1$ is connected to a node $N_1$. A first end of a gate resistance $R_g$ is connected to node $N_1$ and a second end of the gate resistance $R_g$ is connected to a node $N_2$. A first end of an output impedance $R_{OA}$ of the opamp $U_1$ is connected to node $N_1$ and a second end is connected to ground. A first end of gate capacitance $C_g$ is connected to node $N_2$ and a second end is connected to ground. The gate capacitance $C_g$ is connected in parallel to the current source G.

Figure 10:
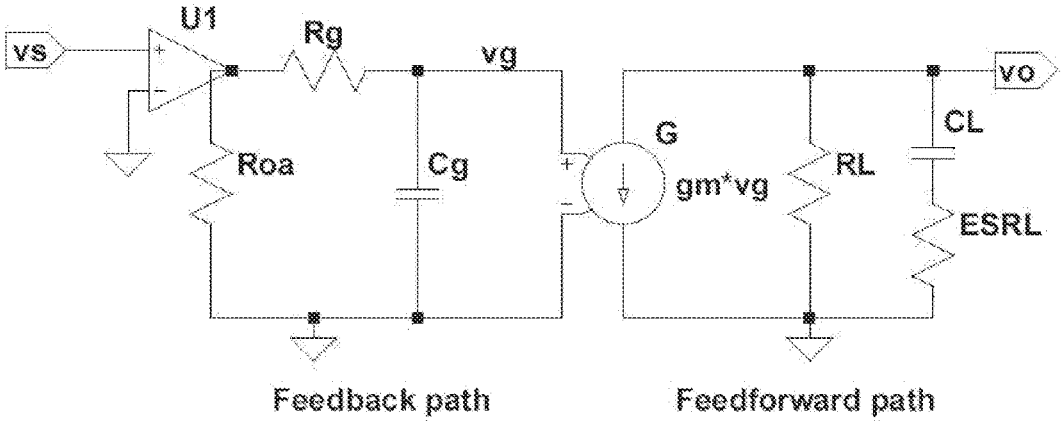
FIG. 10 depicts an example a simplified small signal model.

An N-stage series-parallel resistor/capacitor output loading can be simplified as shown in FIG. 10, where:

$$R_L = R_e * (1 - 1/N)$$

$$R_e = R \parallel R_{DS}$$

$$ESR_L = ESR * (1 - 1/N)$$

$$C_L = \frac{C}{1 - 1/N}$$

In this simplified model, there exists two poles and one zero in the transfer function. First, an isolated pole formed in the feedback path by the MOSFET gate capacitance:

$$p_1 = -\frac{1}{(R_{oa} + R_g)C_g}$$

A second pole is formed by the loading capacitance:

$$p_2 = -\frac{1}{(R_L + ESR_L)C_L}$$

Finally the zero is formed by the series resistance with the loading capacitance:

$$z_1 = -\frac{1}{ESR_L * C_L}$$

Auto-Balance Shunt Circuitry

In some embodiments, the laddered shunt circuitry comprises one or more series-connected loads. The load current is directly proportional or inversely proportional to clock frequency. For instance, a clock operates in a nominal frequency of 1 GHz for a load current 1 A; when the clock operates in slightly higher frequency, say 1.1 GHz, the load current is driven with 1.1 A. Non-limiting examples of the nominal frequency include a frequency between 1 Hz and 10 Hz, or between 10 Hz and 100 Hz, or between 100 Hz and 1K Hz, or between 1K Hz and 10K Hz, or between 10K Hz and 100K Hz, or between 100K Hz and 1 G Hz, or between 1 G Hz and 10 G Hz, or 10 G Hz and higher.

Figure 11:
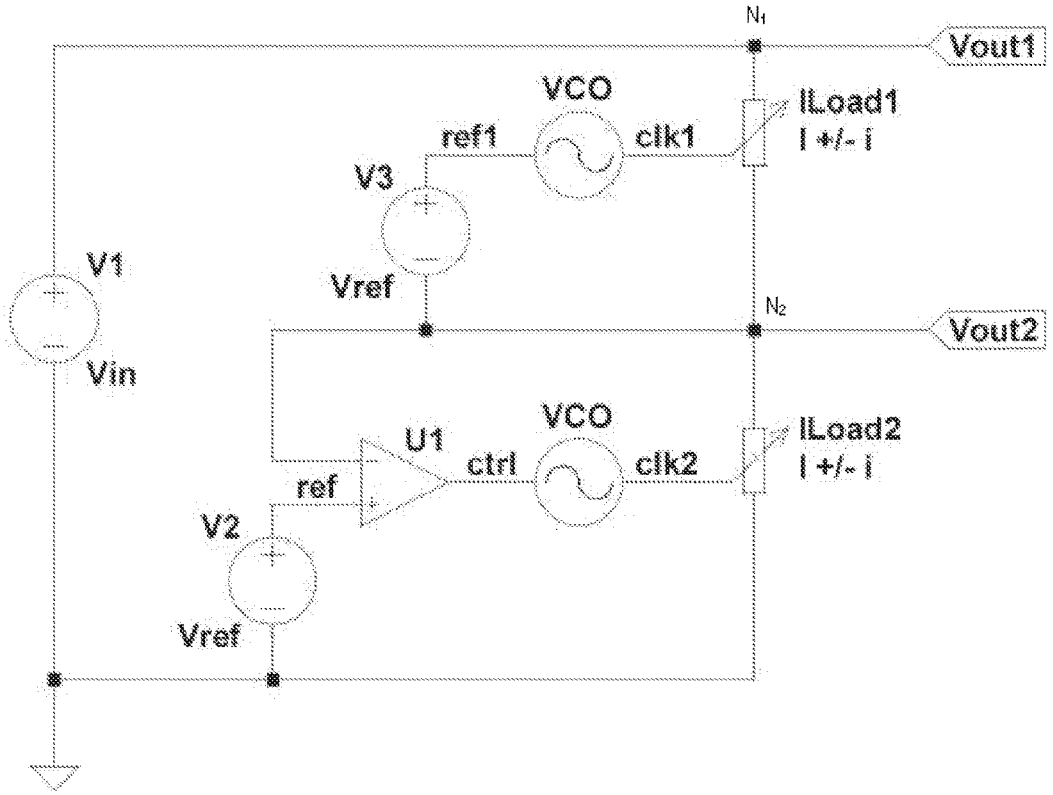
FIG. 11 depicts a circuit diagram of a 2-stage ladder with auto-balance control.

FIG. 11 shows an example of 2-stage ladder with auto-balance control. The first stage includes a first voltage-controlled oscillator (VCO) connected to a first reference voltage $V_{ref}$ with voltage level $V_3$. The first VCO outputs a clock $CLK_1$ to a load $I_{load1}$ connected between a node $N_1$ and a node $N_2$. An input voltage $V_{in}$ is connected to node $N_1$ and serves as the output voltage $V_{out1}$ for the load $I_{load1}$. Load $I_{load1}$ is uncontrolled and serves as a reference for all other stages to match. The second stage includes a second reference voltage $V_{ref}$ with a voltage level $V_2$, an error amplifier $U_1$, and a second VCO. The second reference voltage $V_{ref}$ is connected to a positive input terminal of the error amplifier $U_1$. A negative input terminal of the error amplifier $U_1$ is connected to node $N_2$. An output of the amplifier $U_1$ is connected to the second VCO. Under control of the output signal from the error amplifier $U_1$, the second VCO outputs a clock $CLK_2$ to a load $I_{load2}$. The load $I_{load2}$ is connected between node $N_2$ and ground to receive the output voltage $V_{out2}$ which is regulated.

As the output voltage $V_{out2}$ deviates from the second reference voltage $V_{ref}$, the error amplifier $U_1$ oppositely trims the clock $CLK_2$ of load $I_{load2}$ from its nominal frequency until the output voltage $V_{out2}$ matches the second reference voltage $V_{ref}$. This action is referred to as auto-balancing since the control circuits automatically equalize the load currents to achieve per-load voltage regulation.

More specifically, to regulate the output voltage $V_{out2}$, the error amplifier $U_1$ compares the output voltage $V_{out2}$ to the second reference voltage $V_{ref}$ and generates a control signal ctrl. If the output voltage $V_{out2}$ is greater than the second reference voltage $V_{ref}$, the control signal ctrl will have a negative polarity. The greater the magnitude of the control signal ctrl with the negative polarity, the more the second VCO decreases the frequency of the clock $CLK_2$ in order to decrease the output voltage $V_{out2}$. However, if the output voltage $V_{out2}$ is less than the second reference voltage $V_{ref}$, the control signal ctrl will have a positive polarity. The greater the magnitude of the control signal ctrl with the positive polarity, the more the second VCO increases the frequency of the clock $CLK_2$ in order to increase the output voltage $V_{out2}$.

Figure 12:
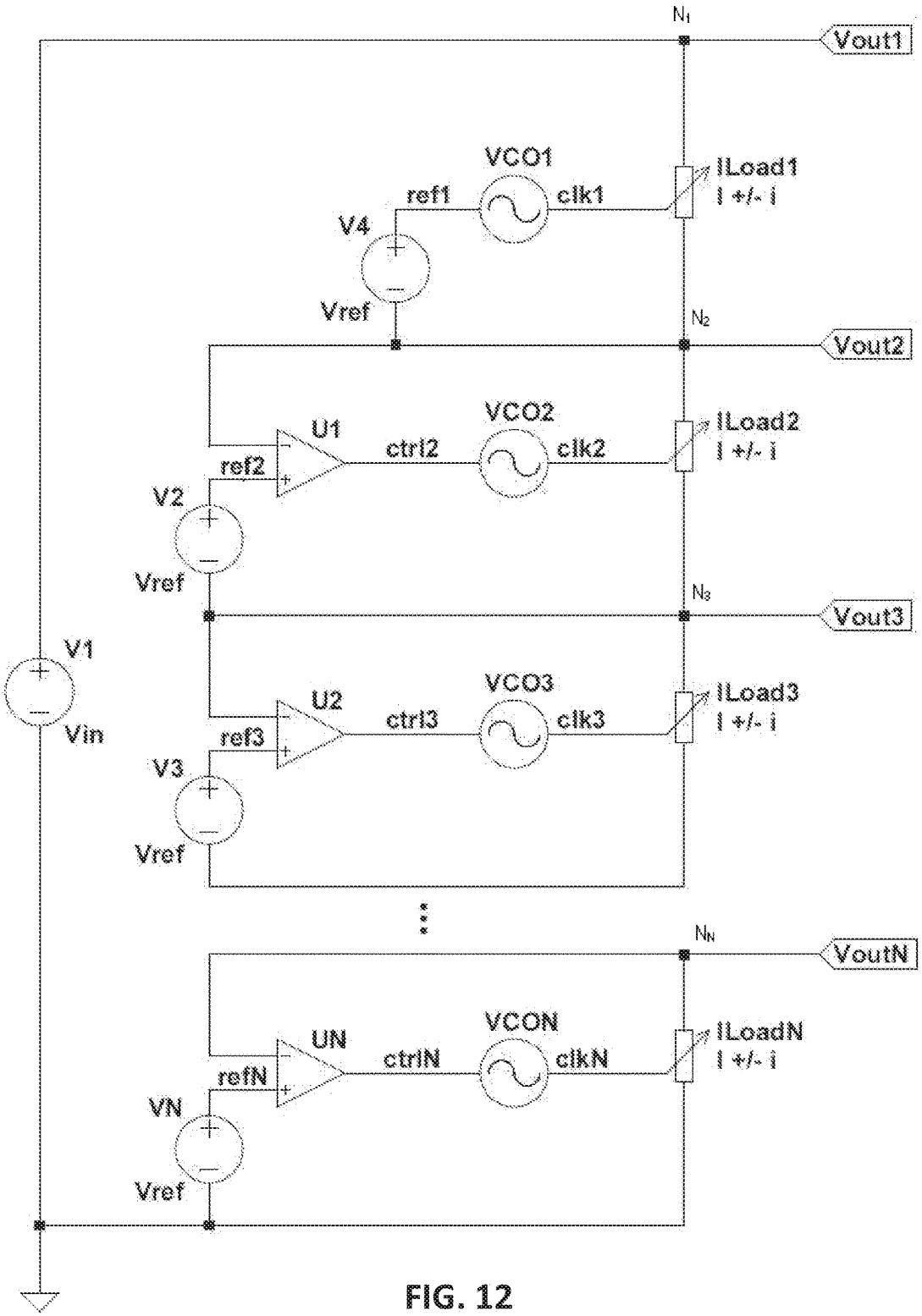
FIG. 12 depicts a circuit diagram of an N-stage ladder with auto-balance control.

FIG. 12 shows an example N-stage ladder. As can be seen, consecutive stages may be added under the 2-stage ladder of FIG. 11 in series to form the N-stage ladder circuit. For example, two, three, four, five, six, or more stages may be arranged. N can be any whole number of 2 or greater. Like in FIG. 11, each stage in the N-stage ladder, except for the first stage, regulates an output voltage $V_{out}$ of a load $I_{load}$.

Figure 13:
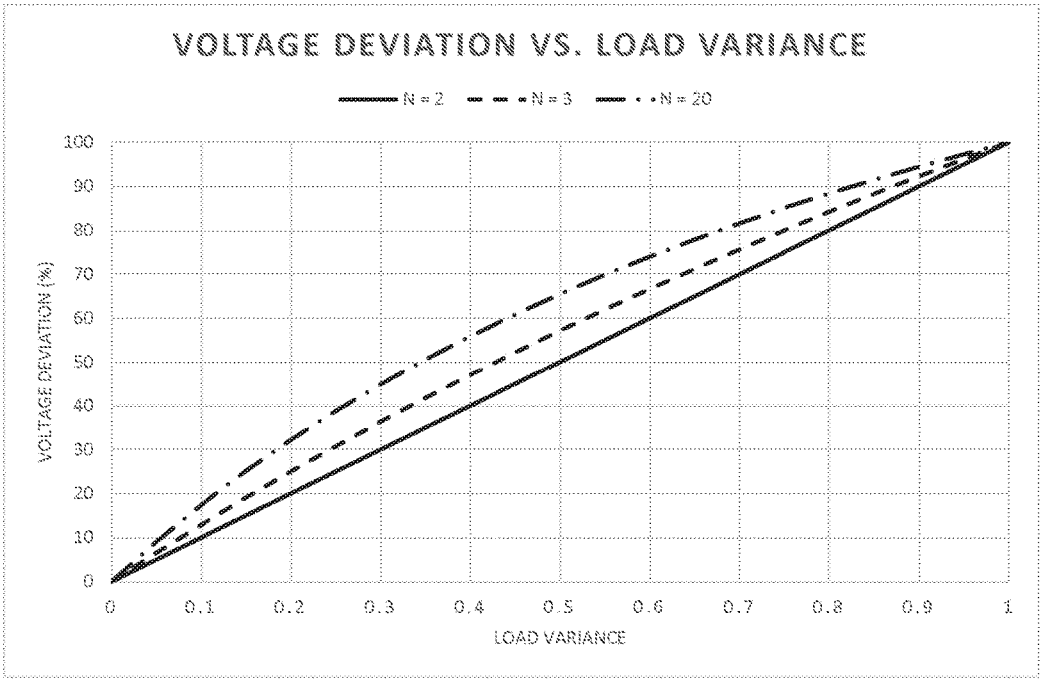
FIG. 13 depicts a plot of a maximum load voltage deviation vs. a normalized load variance for an unregulated ladder.
Figure 14:
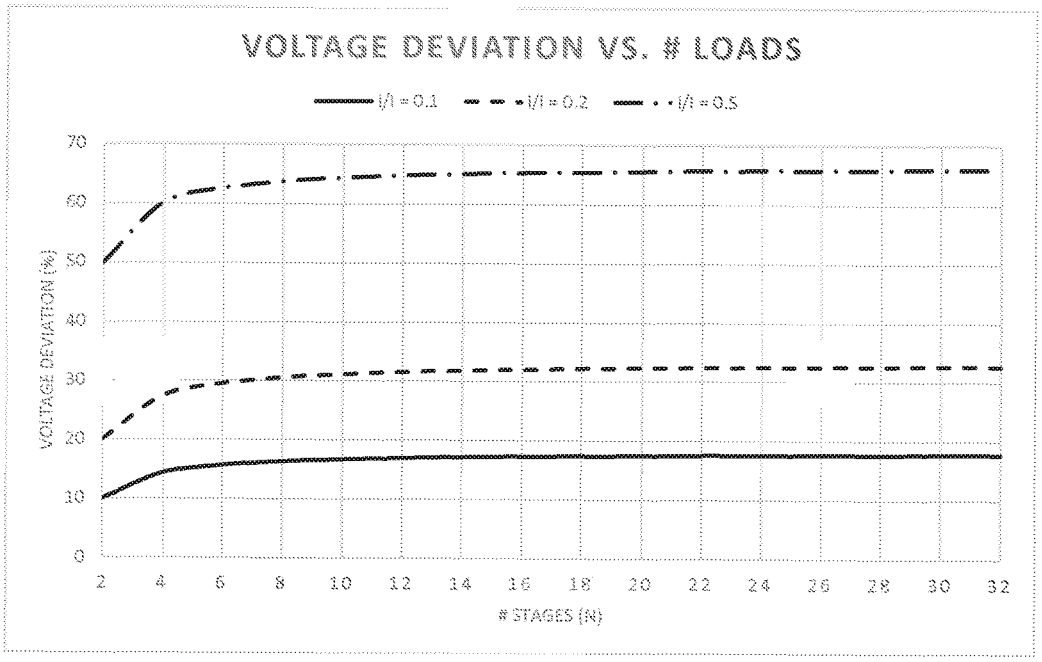
FIG. 14 depicts a plot of a maximum load voltage deviation vs. a number of stages for an unregulated ladder.

If unregulated, a ladder circuit of N loads, each with nominal load current I and variance i, has a maximum voltage deviation of:

$$\frac{\Delta V}{V}[\%] = \frac{2(1 - 1/N)i/I}{1 + (1 - 2/N)i/I} * 100\%$$

$$\frac{\Delta V}{V}$$

versus i/I and number of loads N is plotted in FIG. 13 and FIG. 14. The more loads, the larger the voltage deviation; the higher load variance, the higher voltage deviation. In other words, when voltage has high variance, the load current may become much unstable, and vice versa. Voltage regulators help avoid these situations. To remove the voltage deviation, a circuit may compensate for the variance i which exists between loads. One method of compensation may be based on utilizing a shunt device to sink additional current as described above. However, the additional current carried by the shunts may be burned as power losses and are proportional to the loading mismatch. As a result, efficiency suffers under a worse case with loading mismatch. Instead of sinking additional current to compensate for loading mismatch, a lossless method of achieving the same goal would be to adjust the load directly until the load currents are matched.

For digital integrated circuits, the load current may be proportional to the clock rate. Thus, it is conceivable to build a circuit which can trim the load current by means of adjusting the clock rate away from its nominal value to compensate for variance i described above.

An auto-balance circuit utilizes an error amplifier in negative feedback to drive a voltage-controlled oscillator. By comparing the load voltage to a reference, the error amplifier may create a control voltage representing the error between the desired load voltage and the actual load voltage. The control signal is fed into a voltage-controlled oscillator, which may trim the load's clock rate in opposition to the error in load voltage, until the error reaches 0.

The auto-balance circuit may ensure each load consumes equal current, thus maintaining equal voltage across each load, without consuming additional power. While system performance is affected, the power efficiency excluding the control circuits may be 100%.

In an embodiment, the system performance may be proportional to the clock rate, the worst case system performance can be determined given the above architecture. With a ladder of N loads, consuming nominal current I with variance i, the worst case performance (normalized) occurs when $I_{load1}=1-i/I$ and $I_{load,N}=1+i/I$. In this condition, the reference load consumes the least power per unit performance while all others consume the most power per unit performance. Thus, $I_{load,N}$ are scaled down by 2i/I to match $I_{load1}$. Expressed as performance efficiency, this becomes:

$$\eta_{perf}[\%] = \frac{1+(N-1)(1-2i/I)}{N} = 1-2(1-1/N)i/I[\%]$$

As N becomes large, the worst case performance impact approaches 2i/I, or twice the normalized load current variation. In other words, in some applications where there are too may stages, the overall performance may be deteriorated by a percentage of 2i/I.

A person of ordinary skill in the art will recognize many variations may exist based on the teaching described herein. The steps may be completed in a different order. Steps may be added or deleted. Some of the steps may comprise sub-steps. Many of the steps may be repeated as often as if beneficial to the platform.

Each of the examples as described herein can be combined with one or more other examples. Further, one or more components of one or more examples can be combined with other examples.

Reference is made to the following claims which are part of the present disclosure, including combinations recited by multiple dependent claims dependent upon multiple dependent claims, which combinations will be understood by a person of ordinary skill in the art and are part of the present disclosure.

While preferred examples of the present invention have been shown and described herein, it will be obvious to those skilled in the art that such examples are provided by way of example only. It is not intended that the invention be limited by the specific examples provided within the specification. While the invention has been described with reference to the aforementioned specification, the descriptions and illustrations of the examples herein are not meant to be construed in a limiting sense. Numerous variations, changes, and substitutions will now occur to those skilled in the art without departing from the invention. Furthermore, it shall be understood that all aspects of the invention are not limited to the specific depictions, configurations or relative proportions set forth herein which depend upon a variety of conditions and variables. It should be understood that various alternatives to the examples of the invention described herein may be employed in practicing the invention. It is therefore contemplated that the invention shall also cover any such alternatives, modifications, variations or equivalents. It is intended that the following claims define the scope of the invention and that methods and structures within the scope of these claims and their equivalents be covered thereby.

What is claimed is:

1. A voltage regulator circuit for regulating output voltages across a plurality of loads at a plurality of output nodes, the output nodes including at least a first node, a second node, and a third node, a first load coupled between a first output voltage at the first node and a second output voltage at the second node, and a second load coupled between the second output voltage at the second node and the third node, the voltage regulator circuit comprising:

a first stage including a first voltage controlled oscillator coupled to a first reference voltage and configured to output a first clock signal to the first load; and a second stage coupled in series with the first stage, the second stage including:

an error amplifier coupled to a second reference voltage at a first input terminal and the second output voltage at a second input terminal, and configured to generate a control signal at an output terminal based on a comparison between the second output voltage and the second reference voltage, the control signal at a first polarity responsive to the second output voltage being greater than the second reference voltage and at a second polarity responsive to the second output voltage being less than the second reference voltage;

a second voltage controlled oscillator configured to adjust a second clock signal output to the second load, the second voltage controlled oscillator decreasing a frequency of the second clock signal responsive to the control signal at the first polarity and increasing the frequency of the second clock signal responsive to the control signal at the second polarity to regulate the second output voltage at the second node.

2. The voltage regulator circuit of claim 1, wherein a frequency of the first clock signal is fixed to a nominal frequency of the first load.

3. The voltage regulator circuit of claim 1, wherein the first node is coupled to an input voltage of the voltage regulator circuit.

4. The voltage regulator circuit of claim 1, wherein the plurality of nodes comprise a fourth node, a third load coupled between a third output voltage at the third node and the fourth node, the voltage regulator circuit further comprising:

a third stage coupled in series with the second stage, the third stage comprising:

an additional error amplifier coupled to a third reference voltage at a third input terminal and the third output voltage at a fourth input terminal, and configured to generate an additional control signal at an additional output terminal based on a comparison between the third output voltage and the third reference voltage, the additional control signal at the first polarity responsive to the third output voltage being greater than the additional reference voltage and at the second polarity responsive to the third output voltage being less than the additional reference voltage;

a third voltage controlled oscillator configured to adjust a third clock signal output to the third load, the third voltage controlled oscillator decreasing a frequency of the third clock signal responsive to the additional control signal at the first polarity and increasing the frequency of the third clock signal responsive to the additional control signal at the second polarity to regulate the third output voltage at the third node.

5. The voltage regulator circuit of claim 1, wherein responsive to the error amplifier generating the control signal with the first polarity and a magnitude, the second voltage controlled oscillator further configured to decrease the frequency of the second clock signal by an amount according to the magnitude of the control signal.

6. The voltage regulator circuit of claim 1, wherein responsive to the error amplifier generating the control signal with the second polarity and a magnitude, the second voltage controlled oscillator further configured to increase the frequency of the second clock signal by an amount according to the magnitude of the control signal.

* * * * *